US005725942A

United States Patent [19]

Starita et al.

[11] Patent Number: 5,725,942

[45] Date of Patent: Mar. 10, 1998

[54] SHAPED, WATER-EXPANDABLE, SEALANT ARTICLE OF MANUFACTURE

[75] Inventors: Piero Starita; Paolo Gasperini, both of Leghorn, Italy

[73] Assignee: Laviosa Chimica Mineraria S.p.A., Leghorn, Italy

[21] Appl. No.: 773,005

[22] Filed: Dec. 24, 1996

Related U.S. Application Data

[63] Continuation-in-part of Ser. No. 568,630, Dec. 7, 1995, abandoned.

[30] Foreign Application Priority Data

Dec. 30, 1994 [EP] European Pat. Off. ..... 94120936

[51] Int. Cl.[6] ..... B32B 5/16; D02G 3/00; C08J 3/00; C08L 1/00

[52] U.S. Cl. ..... 428/327; 428/364; 428/370; 524/31; 524/32; 524/35; 524/284; 524/366; 524/386; 524/387; 524/388; 524/445; 524/447

[58] Field of Search ..... 524/31, 32, 35, 524/284, 366, 386, 387, 388, 445, 447; 428/370, 364, 327

[56] References Cited

U.S. PATENT DOCUMENTS 4,514,538 4/1985 Shvakham et al. ..... 524/315
4,534,925 8/1985 Harriett ..... 264/281
5,300,291 4/1994 Sablotsky et al. ..... 424/78.18
5,484,834 1/1996 Chung ..... 524/446

FOREIGN PATENT DOCUMENTS

WO9423137 10/1984 WIPO .

OTHER PUBLICATIONS

Katsumi, Waterproof Sheet, Patent Abstracts of Japan, vol. 17, No. 430 2 pages, Oct. 8, 1993.

Abstract of US 4,534,926, filed 27 Apr. 1984, Todd D. Harriett.

*Primary Examiner*—Patrick Niland
*Attorney, Agent, or Firm*—Browdy and Neimark

[57] ABSTRACT

A water-expandable, sealant article of manufacture comprising a water swellable smectite clay dispersed in an organic liquid consisting of C2–C6 aliphatic polyhydric alcohols and a binder comprising a copolymer of acrylic ester of lower alkyl alcohols. The composition is used for the manufacture by extrusion of highly flexible and elastic strip-shaped or sheet-shaped products for waterproofing works in the field of building.

19 Claims, No Drawings

SHAPED, WATER-EXPANDABLE, SEALANT ARTICLE OF MANUFACTURE

This is a continuation-in-part application of parent application Ser. No. 08/568,630, abandoned, filed on Dec. 7 1995.

FIELD OF THE INVENTION

The present invention relates to the field of waterproofing materials used in the field of building and in civil and industrial engineering. More precisely, the invention relates to a shaped, water-expandable article of manufacture based on a water swellable smectite clay suited to be formed, in particular by extrusion, for the production of a flexible cord- or strip-shaped product which can be used in concrete structures and similar applications, for example to assure the joint seal in-cold joints of concrete structures, or for the production of flat sheets for use in the field of building.

DESCRIPTION OF THE PRIOR ART

The use of water swellable smectite clays, such as, in particular, bentonite containing sodium ions as exchangeable cations, is well known for the production of waterproofing panels which are widely used in the field of construction and in civil and industrial engineering. One may refer to, for example, European Patents n. 0059625, n. 0278419, and the published PCT application n. W094/23137 in the name of the same applicant. Said panels are formed by a layer of granulated bentonite, preferably sodium bentonite, with a percentage of silica no lower than 50%, and with a thickness of the layer comprised between 4 and 10 mm. The layer of bentonite is placed between at least two containment layers formed in different materials to give the panel the property of good mechanical resistance on the one hand, and good permeability on the other. These waterproofing panels are Used for lining terrain to be used for both civil and industrial dumping, for the isolation of watersheds and artificial basins, for the waterproofing of spaces located under ground level, floors of terraces, etc.

The waterproofing effect is created by the properties of water absorbency and swelling of the bentonite. Bentonite is able to absorb from 3 to 8 times its weight in water, depending on its quality, fineness, percentage of sodium ions among the exchangeable ones and other parameters. When hydrated, the bentonite expands and swells to 10 to 17 times the volume of its normal state (considering the normal state to already have 10–12% humidity), thus forming a compact, waterproof layer, without any discontinuity.

From U.S. Pat. No. 4,534,926, a composition primarily of bentonite is also well known, and can be used to manufacture, by extrusion, products in the form of cords, sheets and the like, to be used as barriers against the penetration of water through concrete structures, floors, basins and the like. Said composition comprises bentonite and polypropylene and/or polybutylene as well as an elastomer, such as butyl rubber. The resulting extruded product proves sufficiently tacky to be able to adhere to the structure, and is able to be manipulated without significantly reducing the absorbent properties of the clay and, therefore, its ability to swell. The problem which makes the use of the products according to said composition less than practical is the fact that they are difficult to handle and do not have a satisfactory cohesion and are subject to crumbling in the presence of water, for which reason they can become useless if they are not covered immediately by the casting. On the other hand, the use of compacting agents reduces the capacity for absorption of water by the clay by an unacceptable amount, thus reducing its effect. To limit this inconvenience, the commercial product according to U.S. Pat. No. 4,534,926 is covered by a synthetic containment net.

SUMMARY OF THE INVENTION

An object of the present invention is to provide a shaped, water-expandable article of manufacture based on water swellable smectite clay and suitable to be produced by extrusion in the form of a flexible cord- or strip-shaped product or sheet shaped product having adequate cohesion and depth of compactness for the above-mentioned uses, and which remains unaltered in its capacity for water absorption and swelling.

A further object of the present invention is to provide a sealing strip of primarily water swellable smectite clay able to be easily handled both during storage and installation.

Another object of the present invention is to provide a strip of the above-mentioned type able to swell, but also to conserve its form for a very long period of time, even in the presence of water.

These objects are accomplished by the shaped, water-expandable article of manufacture according to the present invention suitable for the containment of water seepage through structures to which it is applied which comprises smectite clay, able to swell in water, an aliphatic polyhydric alcohol comprised between 2 and 6 carbon, and a binder composed of a copolymer of acrylic esters of lower alkyl alcohols, extruded into a predetermined shape. In this way, it is possible to wet the clay to make it mixable, without compromising its capacity for absorption, whereas the binder used, besides giving resistance to the product, also gives it a high degree of flexibility, allowing the strip to be coiled into large rolls.

In particular, as an additive for improving the binding properties of the binder formed by a copolymer of acrylic esters of lower alkyl alcohols, a polymer of acrylic acid can be used.

DESCRIPTION OF A PREFERRED EMBODIMENT

The smectite clay used in the present invention is preferably sodium bentonite because of its high content of sodium ions from which its swelling properties are derived. Alternatively, activated calcium bentonite can be used in which, that is, calcium ions are substituted for sodium ions, or other types of clay can be used such as hectorite, beidelite, saponite and the like. The particle size of smectite clay used is comprised between 100 and 300 mesh. Since the degree of fineness of the sodium bentonite used influences the swelling, in the preparation of the sealant products according to the present invention, the use of bentonite with a very fine particle size, for example comprised between 200 and 300 mesh, is preferred.

Among the polyhydric alcohols that can be used for the purposes of the present invention, glycerine, ethylene glycol and their derivatives and mixtures are preferred. Since these products boil at a temperature higher than water, that is they have a lower vapor pressure, they can maintain the plasticity of the product for a long time without risk of drying during storage. Other polyhydric alcohol that can be advantageously used in the present invention are propylene glycol, erythritols, pentaneopentaols such as pentaerytritols, trimethylolethane, trimethylol propane, ditrimethylolpropane, hexanehexaols such as sorbitol.

The binder is a copolymer of acrylic esters of the type $CH_2{=}CH{-}COOR$ wherein R is a lower alkyl, i.e. methyl, propyl, isopropyl, n-butyl, isobutyl and t-butyl.

A copolymer of acrylic esters of lower alkyl alcohols which can be advantageously used is the commercially known product called Policril® or any equivalent product. This product acts as a binder for the clay material and gives high flexibility to the products. Advantageously it can be added with a polymer of the acrylic acid (for example the product known as Acriflow®, which exhibits similar binding properties).

Various additives, of generally known types, can be added to the composition according to the present invention. Among these, agents suited to increase the viscosity of the water, such as alkyl derivatives of cellulose (carboxymethylcellulose, carboxyethylcellulose, hydroxyethylcellulose, hydroxypropylmethylcellulose, hydroxyethylmethylcellulose, hydroxybutylcellulose, alkylcelluloses such as methylcellulose and ethylcellulose, microcrystalline cellulose, etc.) are particularly important for the present composition. Carboxymethylcellulose is particularly preferred for the purpose of the invention. The increase in the viscosity of the water contained in the composition contributes to the increase in the elasticity and flexibility of the composition necessary for its use.

In the product according to the present invention, the percentage by weight of the water swellable smectite clay is comprised between 35 and 65% of the total weight water free basis, and preferably between 40 and 60%.

The polyhydric alcohols, in particular glycerine and/or ethylene glycol, are preferably contained in a percentage between 10 and 40% by weight water free basis, and preferably between 15 and 30%.

The copolymer binder is contained in a percentage comprised between 10 and 45% by weight, and preferably between 30 and 40% water free basis.

The additive binder based on polymers of the acrylic acid is generally contained in a water free basis weight percentage no higher than 20% and preferably no higher than 10%.

The carboxymethylcellulose (CMC) or equivalent additive suited to increase the viscosity of the water is contained in a percentage by weight no higher than 5% of the water free weight.

The water content of the paste used to produce the article according to the present invention is generally comprised between 10 and 20% of the water free composition, said water content generally comprising water already present in the clay and dilution water of the binders.

Examples of compositions used for the production of the articles according to the invention are given below. For the trials carried out, a sodium bentonite was used having a montmorillonite content greater than 95% and a fineness of 85%<75 microm and the following chemical composition:

$SiO_2$=56.62
$Al_2O_3$=22.10
TiO=0.24
$Fe_2O_3$=3.42
$P_2O_5$=0.03
$MnO_2$=0.08
MgO=4.71
CaO=1.97
$K_2O$=0.15
$Na_2O$=2.93
P.calc.=7.73

EXAMPLE 1

| | |
|---|---|
| Sodium Bentonite (AK powder, 44μ fineness) | 40% |
| Policril ® (water basis) | 35% |
| Glycerine (99%) | 23% |
| CMC | 2% |
| Total | 100% |

As much water as needed, but about 10/15% of the total.

The components are homogenized well, and then the corresponding paste is forced through an extruder with a machine provided with a vacuum device to remove the excess water and form a more compact elongated extrudate product.

EXAMPLE 2

| | |
|---|---|
| Sodium Bentonite BP 100 in powder | 50% |
| Policril ® (water free basis) | 23% |
| Glycerine (99%) | 23% |
| CMC | 4% |
| Total | 100% |

As much water as needed, but about 600 ml per 3 Kg of composition.

Preparation is the same as that of the previous example.

| | |
|---|---|
| Sodium Bentonite BP 100 (fine powder) | 45% |
| Acriflow ® (water free basis) | 15% |
| Policril ® (water free basis) | 20% |
| CMC | 3% |
| Glycerine | 17% |
| Total | 100% |

As much water as needed, but about 400 ml per 3 Kg of composition.

Preparation is the same as that in the previous examples.

As shown in the three examples above, the water-swellable smectite clay is always present in a major amount, i.e. an amount greater in proportion than any other component.

When the above composition is used to form a cord-shaped product, the cord formed has a weight of about 700 gr per linear meter, and is flexible, plastic and also somewhat elastic. The final humidity varies between 10 and 15%. It can advantageously have a rectangular section of 30×15 mm and a length varying between 5 and 7 m. The cross section of the cord can have also other geometrical shapes according to the working needs, such as triangular equilateral with a side of 35 mm or square with a side of 30 mm.

If necessary, the product is subsequently dried for an hour at 70°–90° C.; this primarily prevents the resultant self-supporting cord from dissolving in excess water since, with the heating, a partial increase in the degree of polymerization of the resin occurs with a considerable increase in the compactness of the product and also in the resistance to complete penetration by free standing or excess water.

If the product is extruded in the form of a flat sheet, it can be 5–6 mm thick and a 1 m wide, but obviously these figures can be varied as required. The sodium bentonite content in this product is on the high side percentage level so as to obtain a product with an high density of bentonite particles to give the self-supporting sheet a very long breakthrough time for liquid penetration.

The product according to the present invention is stabile over time, which signifies that its consistency does not change, no separation takes place between the solid and liquid components, and no evaporation takes place since they have a very low vapor pressure. Furthermore, the clay material contained in it remains completely compact. When the product according to the present invention is placed in contact with water, the clay contained in it develops all its swelling properties as if in the dry state.

In order to evaluate the absorbent properties with regard to water of the sealing product according to the present invention, the following tests have been carried out.

a) Tests of dilatation in water (swelling):

the products according to the invention, when put in water, exhibit a volume increase of 3–4 times. Their peculiarity is that they do not flake off and that they maintain unchanged their shape without the need of containment nets. Once the products are taken off the water and exposed to the air or to the sun, they recover the original size.

b) Elasticity:

the products exhibit an elongation due to pull of 10 cm per meter approximately.

We claim:

1. A self-supporting, shaped, water-expandable article of manufacture suitable for the containment of water seepage through structures to which it is applied, comprising a water-swellable smectite clay, a C2–C6 aliphatic polyhydric alcohol and a binder composed of a copolymer of acrylic esters of lower alkyl alcohols, extruded into a predetermined shape, and wherein said water-swellable smectite clay is present in said article in a greater amount than any other component.

2. The article according to claim 1, wherein said water-swellable smectite is sodium bentonite.

3. The article according to claim 1, wherein said polyhydric alcohol is selected from ethylene glycol, propylene glycol, glycerine, erythritols, pentanepentaols, trimethylolethane, trimethylolpropane, ditrimethylolpropane, hexanehexaols and mixtures thereof.

4. The article according to claim 1, wherein said smectite clay is contained in a weight percentage comprised between 35 and 65% water free basis.

5. The article according to claim 1, wherein said potyhydric alcohol is comprised between 10 and 40% by weight water free basis.

6. The article according to claim 1, wherein said copolymer of acrylic esters of lower alkyl alcohols is comprised between 10 and 45% by weight water free basis.

7. The article according to claim 6, wherein said copolymer of acrylic esters of lower alkyl alcohols is comprised between 30 and 40% by weight water free basis.

8. The article according to claim 1, further comprising a polymer of acrylic acid in a weight percentage comprised between 0 and 20% water free basis.

9. The article according to claim 1, further comprising a cellulose derivative selected from the group consisting of carboxyalkylcellulose and alkylcellulose in a weight percentage no greater than 5% water free basis.

10. The article according to claim 9, wherein said cellulose derivative is carboxymethylcellulose.

11. A shaded, water-expandable article of manufacture suitable for the containment of water seepage through structures to which it is applied, in the form of a cord, comprising a water-swellable smectite clay, a C2–C6 aliphatic polyhydric alcohol and a binder composed of a copolymer of acrylic esters of lower alkyl alcohols, extruded into a predetermined shape.

12. The article according to claim 1, in the form of a sheet.

13. The article according to claim 11, wherein said cord has a cross-section selected from the groups consisting of square, equilateral triangular and non-square rectangular.

14. The article according to claim 12, wherein said sheet is flat, has a thickness of about 5–6 mm and a width of approximately 1 m.

15. The article according to claim 12 coiled into roll form.

16. The article of claim 1, adhered to a concrete substrate.

17. The article according to claim 1, wherein said water-swellable smectite clay is present in an amount of at least 40% by weight, on a water-free basis.

18. The article according to claim 1 capable of exhibiting a volume increase of 3–4 times when soaked in water, and then capable of recovering to its original size when dried, said article exhibiting an elongation due to pull of approximately 10 cm per meter.

19. A shaped, water-expandable article of manufacture suitable for the containment of water seepage through structures to which it is applied, comprising an elongated extrudate of a composition consisting essentially of 10–40% by weight, on a water-free basis, of a C2–C6 aliphatic polyhydric alcohol, 10–45% by weight, on a water-free basis, of a binder composed of a copolymer of acrylic esters of C1–C4 alkyl alcohols, optionally up to 20% by weight, on a water-free basis, of a polymer of acrylic acid, optionally up to 5%, on a water-free basis, of a cellulose derivative selected from the group consisting of carboxy alkyl cellulose and alkyl cellulose, an amount greater than any other component up to 65% by weight, on a water-free basis, of a water-swellable smectite clay, and up to about 15% by weight of water, based on 100% by weight said other components.

* * * * *